US009856125B2

(12) United States Patent
Clüsserath et al.

(10) Patent No.: US 9,856,125 B2
(45) Date of Patent: Jan. 2, 2018

(54) FILLING SYSTEM AND FILLING MACHINE FOR FILLING CONTAINERS

(71) Applicant: KHS GmbH, Dortmund (DE)

(72) Inventors: Ludwig Clüsserath, Bad Kreuznach (DE); Manfred Hãrtel, Weilerbach (DE); Bernd Bruch, Weinsheim (DE)

(73) Assignee: KHS GmbH, Dortmund (DE)

( * ) Notice: Subject to any disclaimer, the term of this patent is extended or adjusted under 35 U.S.C. 154(b) by 66 days.

(21) Appl. No.: 14/891,437

(22) PCT Filed: Apr. 19, 2014

(86) PCT No.: PCT/EP2014/001078

§ 371 (c)(1),
(2) Date: Nov. 16, 2015

(87) PCT Pub. No.: WO2014/183827

PCT Pub. Date: Nov. 20, 2014

(65) Prior Publication Data

US 2016/0115009 A1 Apr. 28, 2016

(30) Foreign Application Priority Data

May 14, 2013 (DE) ..... 10 2013 104 938

(51) Int. Cl.
*B67C 3/26* (2006.01)
*B67C 3/10* (2006.01)

(52) U.S. Cl.
CPC ..... *B67C 3/2617* (2013.01); *B67C 3/10* (2013.01); *B67C 3/2634* (2013.01); *B67C 2003/2651* (2013.01)

(58) Field of Classification Search
CPC ..... B67C 3/004; B67C 3/02; B67C 3/225; B67C 2003/228; B67C 2003/2694
USPC ..... 141/89, 90, 91, 92, 93
See application file for complete search history.

(56) References Cited

U.S. PATENT DOCUMENTS 8,776,839 B2 * 7/2014 Clusserath ..... B67C 3/10 141/302

FOREIGN PATENT DOCUMENTS

| | | |
|---|---|---|
| DE | 19 02 948 | 7/1970 |
| DE | 22 51 018 | 5/1974 |
| DE | 75 36 390 | 4/1976 |
| DE | 100 64 954 | 6/2002 |
| DE | 10 2006 014 103 | 9/2007 |

(Continued)

*Primary Examiner* — Timothy L Maust
*Assistant Examiner* — Andrew Schmid
(74) *Attorney, Agent, or Firm* — Occhiuti & Rohlicek LLP

(57) ABSTRACT

A filling element includes a filling-element housing and a liquid-carrying duct formed therein that ends in an opening for discharging liquid product into a container. A liquid valve controls flow through the duct. During filling, a return-gas tube extends into the container's interior. An actuator uses the gas tube as a valve tappet to open and close the liquid valve. As it moves the gas tube up and down, the actuator simultaneously controls a first control-valve that controls flow between the return-gas tube and a gas-chamber. The gas chamber is configured for conducting away return gas forced out of the container's interior by incoming filling product during filling thereof, for imposing a filling pressure in the container's interior, for flushing said container's interior with a flushing gas, or for evacuating the container's interior.

20 Claims, 9 Drawing Sheets

(56) References Cited

FOREIGN PATENT DOCUMENTS

| | | |
|---|---|---|
| DE | 10 2010 022 985 | 12/2011 |
| EP | 1 586 533 | 10/2005 |
| FR | 1 100 155 | 9/1955 |
| WO | WO2011/154068 | 12/2011 |
| WO | WO2014/054027 | 4/2014 |

* cited by examiner

FILLING SYSTEM AND FILLING MACHINE FOR FILLING CONTAINERS

RELATED APPLICATIONS

This application is the national stage under 35 USC 371 of international application PCT/EP2014/001078, filed on Apr. 19, 2014, which claims the benefit of the May 14, 2013 priority date of German application DE 10 2013 104 938.9, the contents of which are herein incorporated by reference.

FIELD OF INVENTION

The invention relates to container processing, and in particular, to a filling system.

BACKGROUND

When filling an empty container, it is sometimes easy to overlook the fact that it is, in fact, already full. However, it is full of gas, not liquid.

A typical filling machine must manage this gas. When filling a container, the liquid displaces the gas. This gas must be disposed of as it leaves the container. In addition, the air that normally fills an empty container has oxygen. This is often harmful to products. As such, it is often useful to flush the container with some inert gas to displace oxygen-laden air. In some cases, it is useful to evacuate the container, so that it truly is empty, or as nearly empty as it is possible to make it. In yet other cases, it is useful to prepare the container to receive liquid by pre-tensioning it with a high pressure pre-tensioning gas A modern filling machine has one or more gas paths to accomplish one or more of these tasks. The need to control these gas paths introduces considerable complexity into the design of a filling machine.

SUMMARY

Among the objects of the invention is that of providing a filling system in which a controlled gas path for provides gas communication between a pressure in a filling-product reservoir and a container's interior.

In one aspect, the invention features a filling element having an actuation device that, when opening and closing the liquid valve of the filling element, creates an axial movement, preferably in the direction of a filling element axis. This axial movement simultaneously causes a first control-valve to transition between opened and closed states.

In some embodiments, the actuation device produces at least two defined axial lifts, one of which is smaller than the other. The first axial lift opens and closes the first control-valve. The second axial lift opens and closes the liquid valve. The second lift preferably adds to the first lift in such a way that, with the second lift alone, the first control-valve also opens and closes.

In one aspect, the invention features a filling system for filling containers with liquid filling-product. Such a filling system includes a filling-product reservoir and a filling element housed in a housing below the reservoir. The housing extends along a vertical filling element axis and forms a liquid-carrying duct that communicates with the reservoir. One end of the duct forms a discharge opening on an underside of the housing. A liquid valve is arranged in the liquid-carrying duct. A return-gas tube forms both a first gas-duct and a valve tappet for the liquid valve. During filling, the return-gas tube extends into a container's interior.

The filling element also has a first gas-chamber for conducting away return gas forced out of the container's interior by the filling product during filling thereof, for imposing a filling pressure in the container's interior, for flushing the container's interior with a flushing gas, or for evacuating the container's interior. An actuator moves the valve tappet axially for opening and closing the liquid valve. By controlling this axial motion, the actuator also controls a first control-valve arranged in a connection between the first gas-duct and the first gas-chamber.

In some embodiments, the actuation device produces two separate axial lifts. The first opens and closes the first control-valve. The second opens and closes the liquid valve. These two lifts add together to cause the first control-valve and the liquid valve to concurrently open and close. Among these embodiments are those in which the actuation device includes two pneumatic cylinders in series, each of which causes one of the two axial lifts. In some of these embodiments, a valve tappet moves along the filling-element axis in response to movement of one of the two pneumatic-cylinders, thereby opening or closing the first control-valve.

Other embodiments include those in which an end of the return-gas tube forms a valve seat with which the first control-valve interacts.

Some embodiments also have a spring to pre-tension the return-gas tube and to bias the liquid valve closed. In these embodiments, the actuation device produces first and second axial-lifts: one to open the control valve and another to open the liquid valve.

In other embodiments, one of two portions of the filling-product reservoir remains free of any filling product. This portion forms the first gas-chamber. An upper end of the return-gas tube extends into this first gas-chamber.

In yet other embodiments, the filling-product reservoir includes first and second portions, of which the first is unoccupied by filling product. It is to this first portion that the first gas-chamber connects. Among these embodiments are those with a second control-valve that connects the first gas-chamber to the first portion of the filling-product reservoir.

In other embodiments, the filling-product reservoir includes first and second portions. In these embodiments, the first portion, which is unoccupied by filling product, forms the first gas-chamber. The second portion, meanwhile, holds filling product. These two portions are sealed from each other.

In some embodiments, the first control-valve includes a ring-shaped valve seat and an edge. The valve seat surrounds the filling element axis. The edge, which is at an upper end of the return-gas tube, interacts with the ring-shaped valve seat to close the first control-valve. Among these embodiments are those that have a second control-valve that connects to a second gas-chamber to open a flow path in a region surrounded by the ring-shaped valve seat. The second control-valve controls flow through this flow path. Some of these embodiments also have a choke disposed in the flow path to restrict gas flow. Others include a vacuum source connected to the second gas-chamber so as to maintain it at an under-pressure. In some of the embodiments, a ring duct common to other filling elements in the filling system forms the second gas-chamber. Yet other ones of these embodiments include a further gas tube surrounded by the return-gas tube and forming a further gas-duct that opens at a lower end of the gas tube in a region of the filling-product discharge opening. In these embodiments, the second control-valve selectively connects the further gas tube with the second gas-chamber. Also among the embodiments are those that include a gas source connected to the second gas-chamber. This gas source supplies the second gas-chamber with either flushing gas or pre-tensioning gas.

Additional embodiments include those in which the filling-element housing includes a tubular housing section that, in operation, extends into the container. In these embodiments, the filling-product discharge opening is provided at the tubular housing section.

Yet other embodiments include a rotor that rotates about a vertical machine axis. In these embodiments, the filling element is one of a plurality of identical filling elements on the rotor.

In another aspect, the invention features a filling element that includes a filling-element housing and a liquid-carrying duct formed therein that ends in an opening for discharging liquid product into a container. A liquid valve controls flow through the duct. During filling, a return-gas tube extends into the container's interior. An actuator uses the gas tube as a valve tappet to open and close the liquid valve. As it moves the gas tube up and down, the actuator simultaneously controls a first control-valve that controls flow between the return-gas tube and a gas-chamber. The gas chamber is configured for conducting away return gas forced out of the container's interior by incoming filling product during filling thereof, for imposing a filling pressure in the container's interior, for flushing the container's interior with a flushing gas, or for evacuating the container's interior.

As used herein, "container" includes a can or a bottle, whether made of metal, glass, or plastic.

As used herein, a container in sealing position with the filling element indicates that the container is pressed tightly with its container mouth tight against the filling element and/or a seal located there.

The expressions "essentially" or "approximately" refer to deviations from an exact value by ±10%, preferably by ±5%, and/or deviations that are insignificant to function.

Further embodiments, advantages, and possible applications of the invention are also derived from the following description of exemplary embodiments and from the figures. All features described and/or represented as images are individually or in any desired combination part of the specification, regardless of their inclusion in the claims or reference made to them. The contents of the claims are also a constituent part of the specification.

BRIEF DESCRIPTION OF THE DRAWINGS

These and other features and advantages of the invention will be apparent from the following detailed description and the accompanying figures, in which.

DETAILED DESCRIPTION

Figure 1:
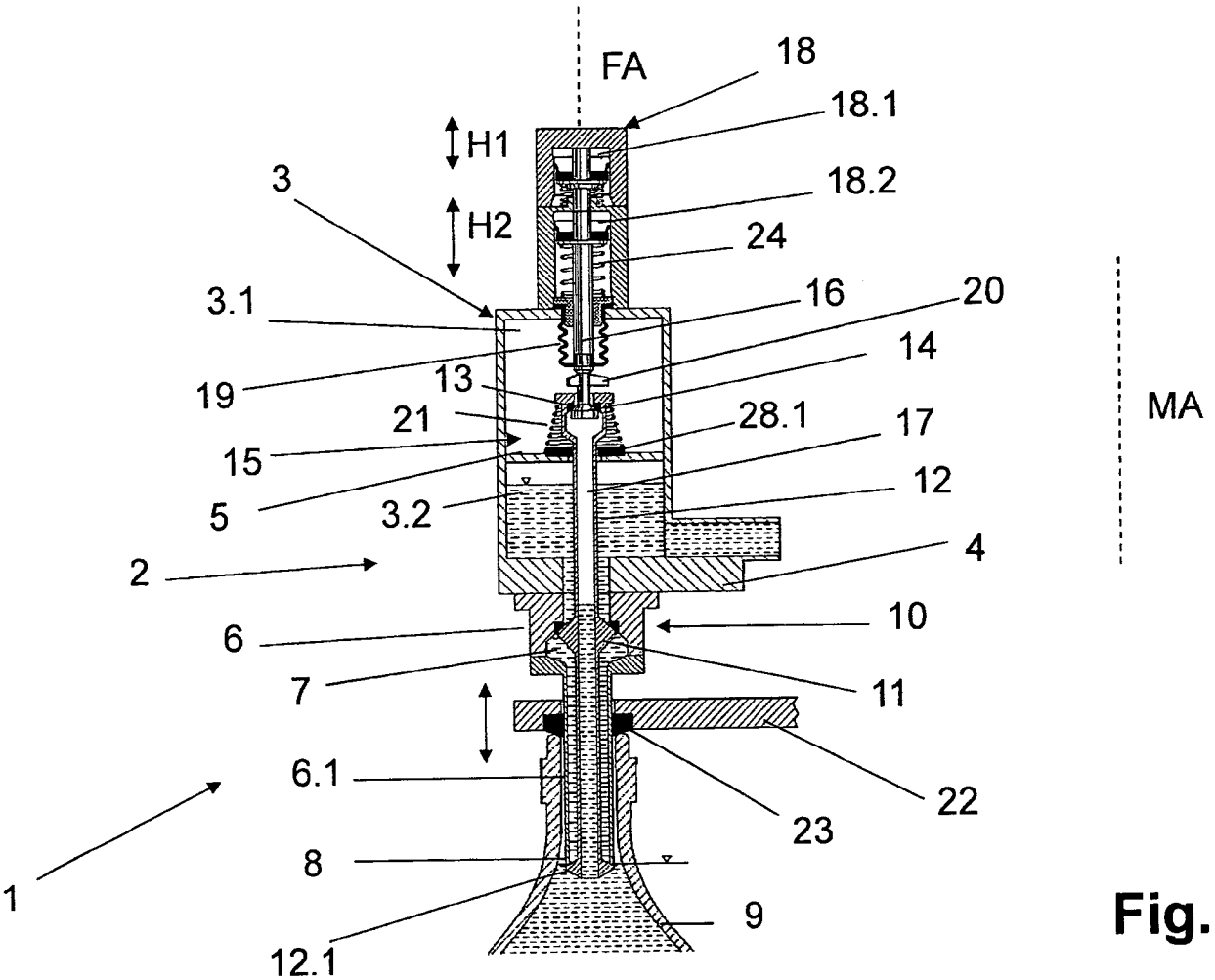
FIGS. 1 and 2 show a filling element.

FIG. 1 shows one of a plurality of identical filling elements 2 of a filling system 1. These filling elements are provided directly on an underside of a ring reservoir 3 that is common to all the filling elements 2. The ring reservoir 3 is a constituent part of a rotor 4 that is driven to rotate about a vertical machine axis MA.

A horizontal partition wall 5 divides the ring reservoir 3 into an upper ring-chamber 3.1 and a lower ring-chamber 3.2. During the filling operation, liquid filling-product partially fills the lower ring-chamber 3.2.

A housing 6 houses the various parts of the filling element 2. The housing 6 has an upper section that extends downward from the rotor 4 and a lower tubular section 6.1 that extends into a container 9. In the illustrated embodiment, the container 9 is a bottle.

A liquid-carrying duct 7 extends through the housing 6. At its upper end, the liquid-carrying duct 7 connects to the lower ring-chamber 3.2 and thus opens into a space occupied by the liquid filling-product. In the lower tubular section 6.1, the liquid-carrying duct 7 forms a filling tube that ends in a discharge opening 8. During filling, the liquid filling-product flows to the container 9 through the discharge opening 8.

A liquid valve 10 upstream of the discharge opening 8 and within the liquid-carrying duct 7 controls flow of the liquid filling-product. The liquid valve 10 has a valve body 11 that is formed at a return-gas tube 12 that is arranged coaxially with a filling-element axis FA. The return-gas tube 12 thus serves as the liquid valve's tappet. Lowering the return-gas tube 12 causes the liquid valve 10 to transition from the closed state, shown in FIG. 1, to an open state.

At its lower end, the return-gas tube 12 widens to form an annular screen 12.1. When the liquid valve 10 closes, the annular screen 12.1 contacts the lower tubular section 6.1 of the housing 6 at the discharge opening 8. This closes an annular space formed by the liquid-carrying duct 7 that surrounds the return-gas tube 12.

The return-gas tube 12 extends upwards through the lower ring-chamber 3.2, through an opening in the partition wall 5, and up into the upper ring-chamber 3.1. Within the upper ring-chamber 3.1 is a valve body 14 that cooperates with a valve seat 13 to form a first control-valve 15. Within the upper ring-chamber 3.1, the return-gas tube 12 engages the valve seat 13.

An actuation device 18 arranged on an upper side of and outside the ring reservoir 3 includes a tappet 16 that is coaxial with the filling-element axis FA. The tappet 16 extends into the upper ring-chamber 3.1. The lower end of the tappet 16 forms the valve body 14. A reset spring 24 pre-tensions the valve tappet 16 into a raised initial position.

When the first control-valve 15 opens, the lower end of the tappet 16 extends into an upper extension of the return-gas tube 12. This creates an opening that connects a return-gas duct 17 formed in the return-gas tube 12 with the upper ring-chamber 3.1. The cross-section of this opening is greater than that of the tappet 16.

The actuation device 18 includes first and second pneumatic cylinders 18.1, 18.2 for vertically moving the tappet 16 by corresponding first and second lifting strokes H1, H2 of differing lengths. A bellows seal 19 seals an opening through which the tappet 16 enters the upper ring-chamber 3.1.

Above the upper end of the return-gas tube 12, the valve tappet 16 includes a carrier 20. In the illustrated embodiment, the carrier 20 has at least two wing arms extending radially away from the valve tappet 16.

A pressure spring 21 surrounds the return-gas tube 12. This pressure spring 21 extends between the partition wall 5 and an upper end of the return-gas tube 12. The pressure spring 21 thus pre-tensions the valve body 11 of the liquid valve 10 so that it remains in the closed position.

The lower tubular section 6.1 extends through an opening in a plate 22. A seal 23 on an underside of the plate 22 surrounds the lower tubular section 6.1 and thus seals this opening.

Figure 4:
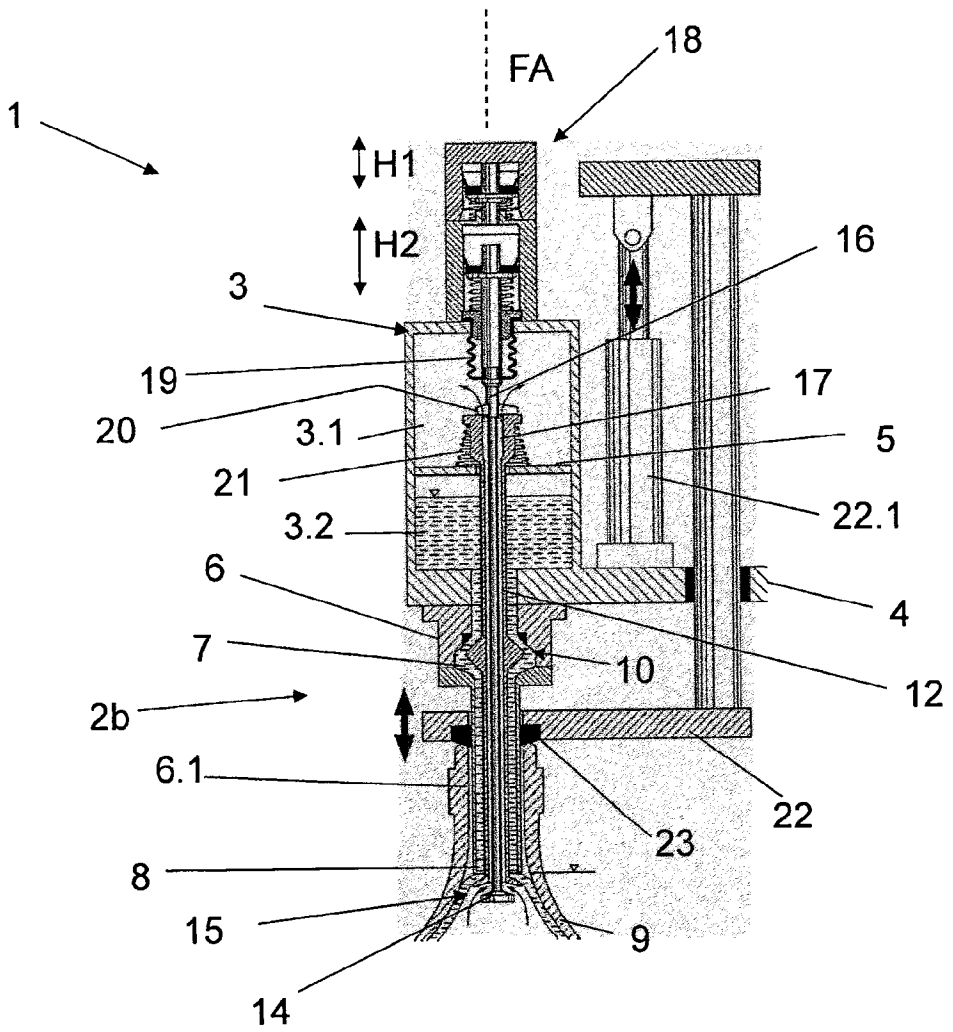
FIGS. 4-9 show further embodiments of a filling element.

An actuation element 22.1, best seen in FIG. 4, raises and lowers the plate 22 in a controlled manner in the direction of the filling element axis FA. The plate 22 with the seal 23 serves in its raised position solely for the pre-setting of the filling height, and during the filling phase is fixed in its position.

A filling element 2 as described above, or more generally, the filling system 1 as a whole, can carry out many different filling methods. However, in all these methods, the lower tubular section 6.1 of the housing 6 and its discharge opening 8 extend through a container opening into the container's head-space.

FIG. 1 shows the first control-valve 15 in its closed state. To open the first control-valve 15, one actuates the first pneumatic cylinder 18.1. This causes the valve tappet 16 to move by the first stroke H1. As a result, the valve body 14 moves downward. In doing so, it forms a connection between the return-gas duct 17 and the upper ring-chamber 3.1. With the liquid valve 10 closed, this connection allows the return-gas duct 17 to communicate the pressure within the upper ring-chamber 3.1 into the container 9. This pressure can be an over-pressure or an under-pressure.

Activating the second pneumatic cylinder 18.2 causes the tappet 16 to move by the larger second stroke H2. This second stroke H2 is added to the first stroke H1, causing the total movement to be the sum of the two. As a result of this movement, the carrier 20 now contacts the upper end of the return-gas tube 12. This, in turn, urges the return-gas tube 12 downward to an extent that overcomes the upward urging of the pressure spring 21. As a result, the valve body 11 moves downward and the liquid valve 14 opens. This begins the filling phase.

To end the filling phase, one deactivates the second pneumatic cylinder 18.2. This allows the pressure spring 21 to again close the liquid valve 10.

In one case, when the first pneumatic cylinder 18.1 is reactivated, the first control-valve 15 remains opened. As a result, the return-gas tube 12 empties into the filled container 9. This means that any filling product that has risen in the return-gas duct 17 during the filling phase can flow out into the filled container 9.

Alternatively, when the pneumatic cylinder 18.1 closes the liquid valve 10, the first control-valve 15 also closes. In that case, filling product remains in the return-gas tube 12. Then, when the first control-valve 15 opens the next time, this filling product empties into the next container to be filled.

The container 9 stands with its base on a container carrier. During the imposition of pressure and during the filling, the plate 22 is lowered onto the container 9 so that the seal 23 tightly contacts the container's mouth. The seal 23 thus seals the gap between the plate 22 and the outer surface of the lower tubular section 6.1. This puts the container 9 in a sealed position at the filling element 2.

During the filling phase, liquid flowing into the container 9 displaces the gas that is already in the container 9. The return-gas duct 17 guides this return gas through the opened first control-valve 15 and into the ring reservoir 3.

The inflow of the liquid filling product automatically ends upon immersion of the lower end of the return-gas tube 12 into the filling product level in the container 9. At this point, liquid filling product will have risen to a certain height in the return-gas duct 17. Under time control, for example, at least the second pneumatic cylinder 18.2 is deactivated to close the liquid valve 10.

Figure 2:
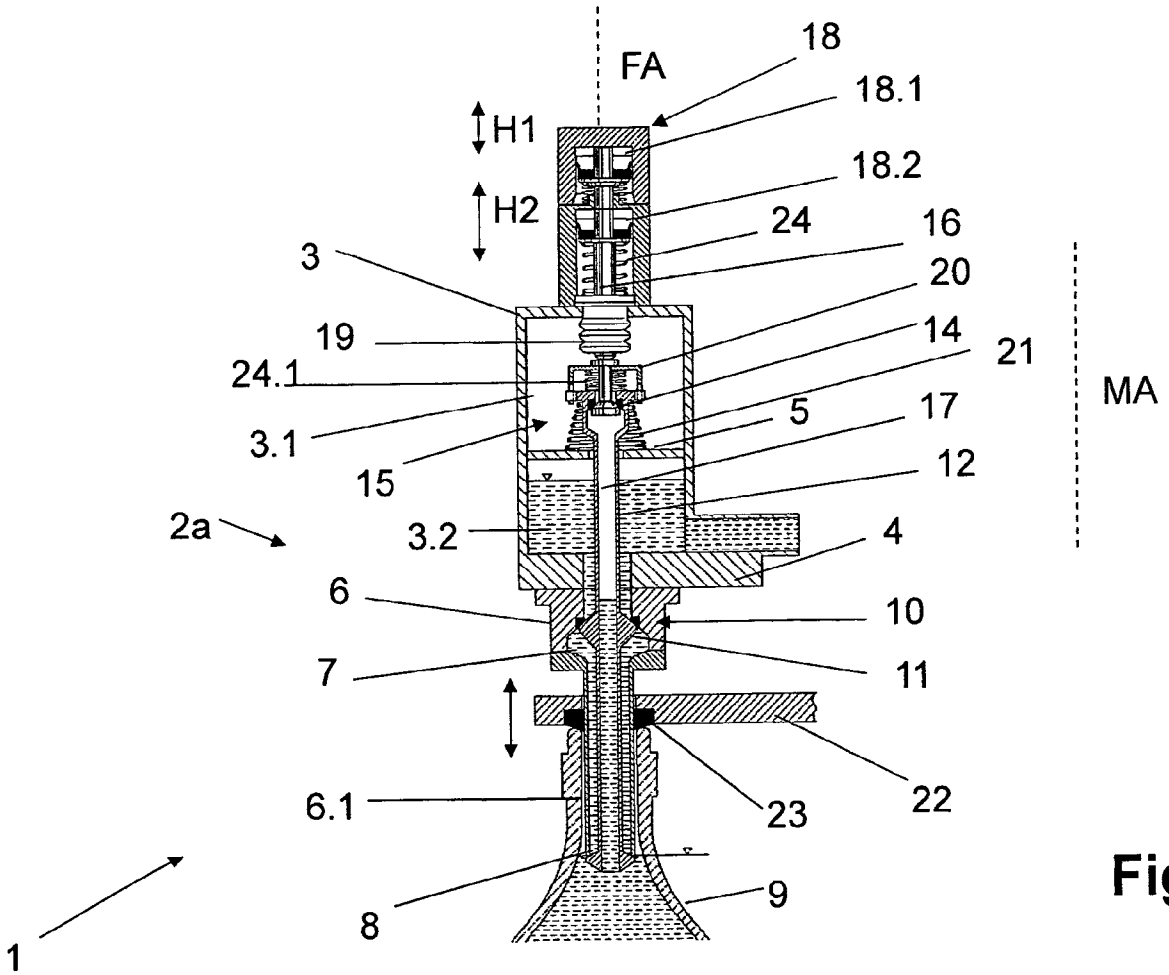
Figure 3:
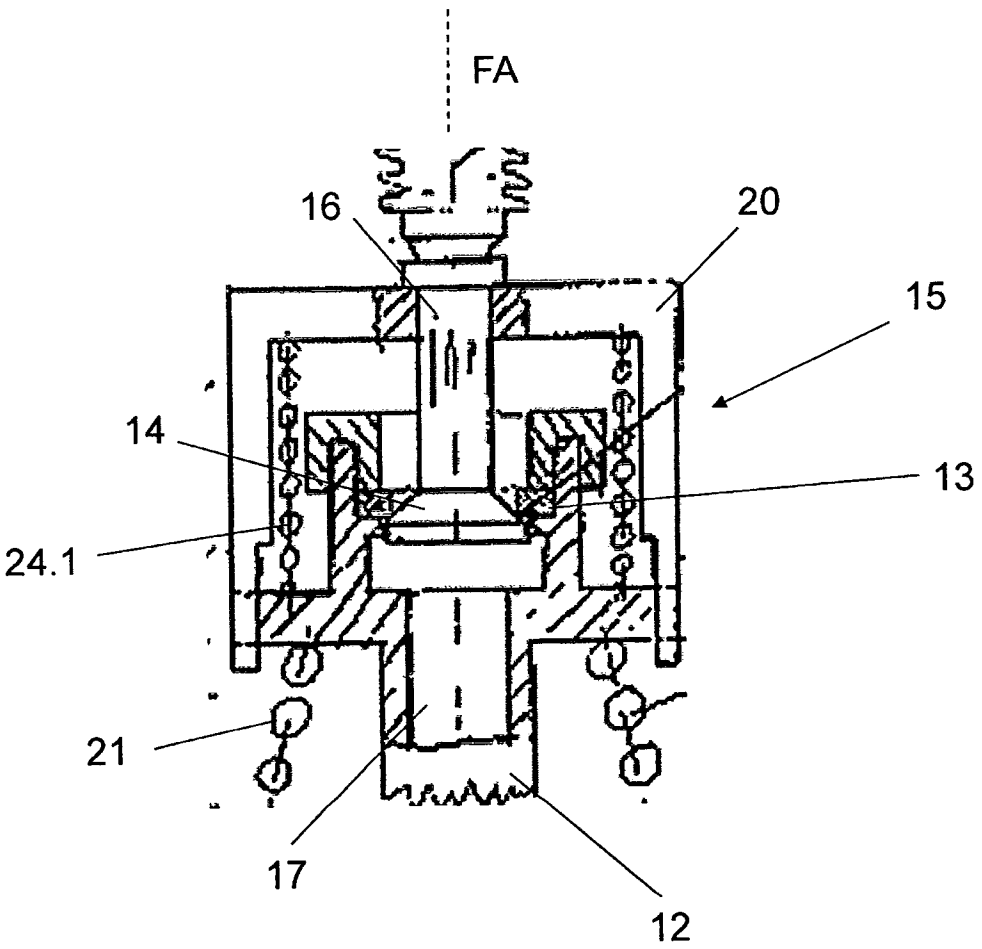
FIG. 3 is a close-up of a portion of the filling element shown in FIG. 2.

FIG. 2 shows an alternative filling element 2*a* in which the carrier 20 does not act directly on the upper end of the return-gas tube 12. Instead, the carrier 20 acts on a further pressure spring 24.1. The further pressure spring 24.1 is dimensioned in such a way that the axial movement of the return-gas tube 12 for the opening of the liquid valve 10 does not take place until the first control-valve 15 has, in fact, opened. FIG. 3 shows the first control-valve 15 and the elements surrounding it in greater detail.

FIG. 4 shows yet another alternative filling element 2*b* in which the valve tappet 16 extends downward such that a distal end thereof is in a region of the underside of the lower tubular section 6.1. The valve body 14 is provided at the distal end of the valve tappet 16. A lower opening edge of the return-gas tube 12 forms a valve seat that interacts with the valve body 14 to form the first control-valve 15. Thus, in this embodiment, the first control-valve 15 is a foot valve.

Figure 5:
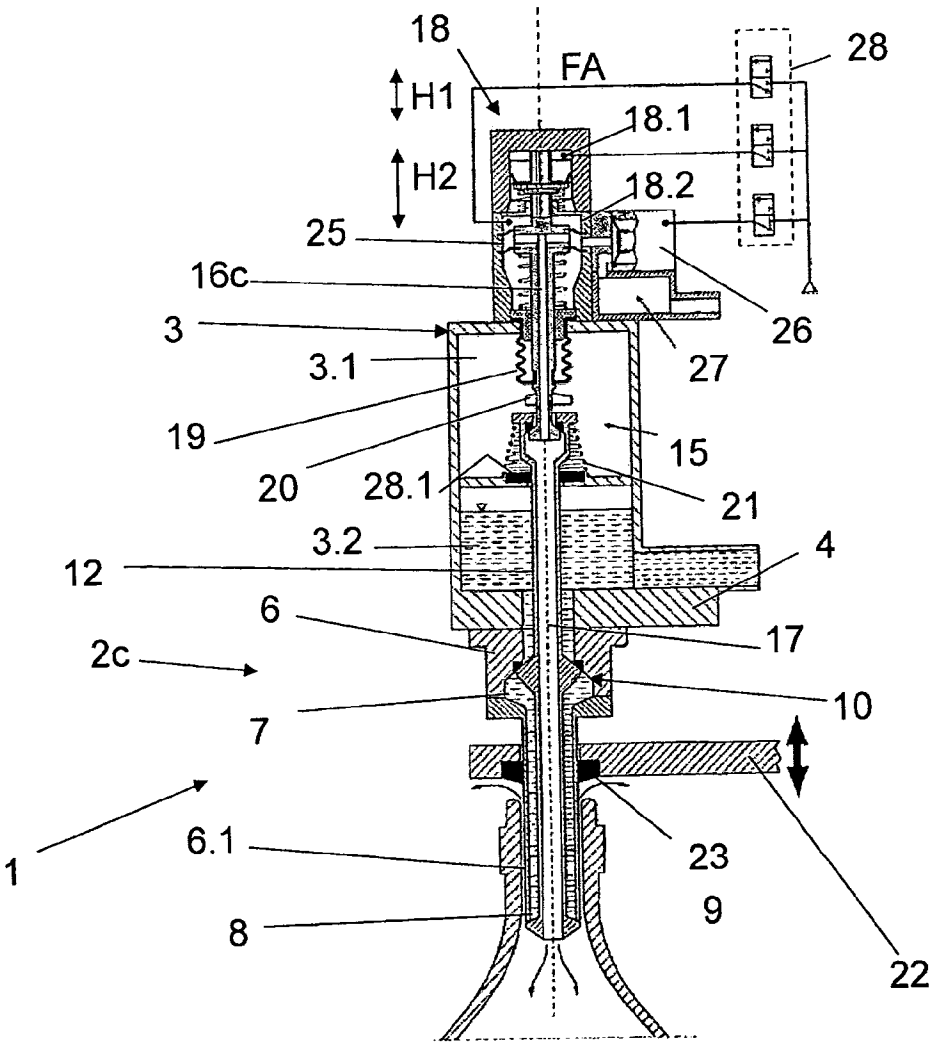

FIG. 5 shows an alternative filling element 2*c* in which a tube 16*c* that is coaxial with the filling element axis FA forms a valve tappet. The tube 16*c* has a lower end and an upper end. The lower end opens at the valve body 14 of the first control-valve 15. The upper end opens into a chamber 25 that is formed between two diaphragms. A second control-valve 26 connects the chamber 25 with a first ring-duct 27 that is common to all the filling elements 2*c* of the filling system 1 and provided at the ring reservoir 3. In the illustrated configuration, the tube 16*c* functions as a piston within the second pneumatic cylinder 18.2.

Each filling element 2*c* has its own independent control-valve arrangement 28. The control-valve arrangement 28 has a plurality of electrically controlled pneumatic valves for actuating the first and second pneumatic cylinders 18.1, 18.2 and the second control-valve 26.

The filling element 2*c* can be used for either vacuum filling or for filling at atmospheric or ambient pressure. To vacuum-fill a container 9, one maintains an under-pressure in the ring reservoir 3. For filling a container 9 at atmospheric pressure or ambient pressure, one maintains the ring reservoir 3 at such atmospheric or ambient pressure.

The filling element 2*c* can also be used to flush the container's interior with flushing gas before filling. A suitable flushing gas is an inert gas, such as $CO_2$ or nitrogen. To carry out such flushing, one conducts flushing gas through the first ring-duct 27 under slight overpressure.

A short horizontal stretch of a control curve responsible for lifting the container 9 ensures that, as the container 9 is lifted towards the filling element 12*c*, it remains open for a short time, i.e. without being pressed against the seal 23.

Opening the second control-valve 26 causes the flushing gas to be blown in through the tube 16*c* and the return-gas duct 17 and into the container 9. The gas follows a path down the middle of the container's interior along the direction of the filling element axis FA.

In an open flushing procedure, as shown in FIG. 5, the flushing gas, together with air displaced from the container 9, exits into the open air. As shown by the arrows in FIG. 5, it does so in the region of the container's mouth through an annular gap formed between the container's inner surface and the lower tubular section 6.1. Upon completion of this flushing, the container 9 is lifted up and pressed against the seal 23.

When used for closed flushing, the tube 16*c* extends as far as the underside of the lower tubular section 6.1. Then, before the closed flushing begins, the plate 22 is lowered to seal the container 9 against the seal 23. In this case, instead of escaping from the container 9 via the annular opening, the flushing gas, together with displaced air, exits the container 9 via the return-gas duct 17, through the opened first control-valve 15, and into the upper ring-chamber 3.1.

In some embodiments, a partition seal 28.1 seals an opening through which the return-gas tube 12 penetrates the partition wall 5. A suitable type of partition seal 28.1 is a diaphragm seal. The partition seal 28.1 prevents flushing gas that flows into the upper ring-chamber 3.1 during the flushing phase from coming in contact with the filling product in the lower ring-chamber 3.2.

However, other embodiments omit the partition seal 28.1. In these embodiments, flushing gas or return gas conducted back into the upper ring-reservoir 3.1 can cross over into the lower ring-reservoir 3.2 and come in contact with the filling product. Since this gas is predominantly inert gas, this embodiment has the advantage of diluting oxygen concentration in the portion of the lower ring-chamber 3.2 that is not occupied by the filling product. Since oxygen is often harmful to a filling product, this suppresses any deterioration of filling product as a result of oxygen exposure.

In general, an advantage of a closed flushing system is that after the flushing phase, the container is filled with inert gas. As a result, during the filling phase the filling product is introduced into a 100% inert gas atmosphere. When the insert gas is $CO_2$, a slight carbonization can be introduced into the product. This is desirable in many products, such as in white wine. The $CO_2$ atmosphere also suppresses loss of any $CO_2$ that is naturally contained in the product.

Using the filling element 2*c*, it is also possible to fill the container's head space after the filling phase with inert gas by using the tube 16*c* controlled by the second control-valve 26.

Figure 6:
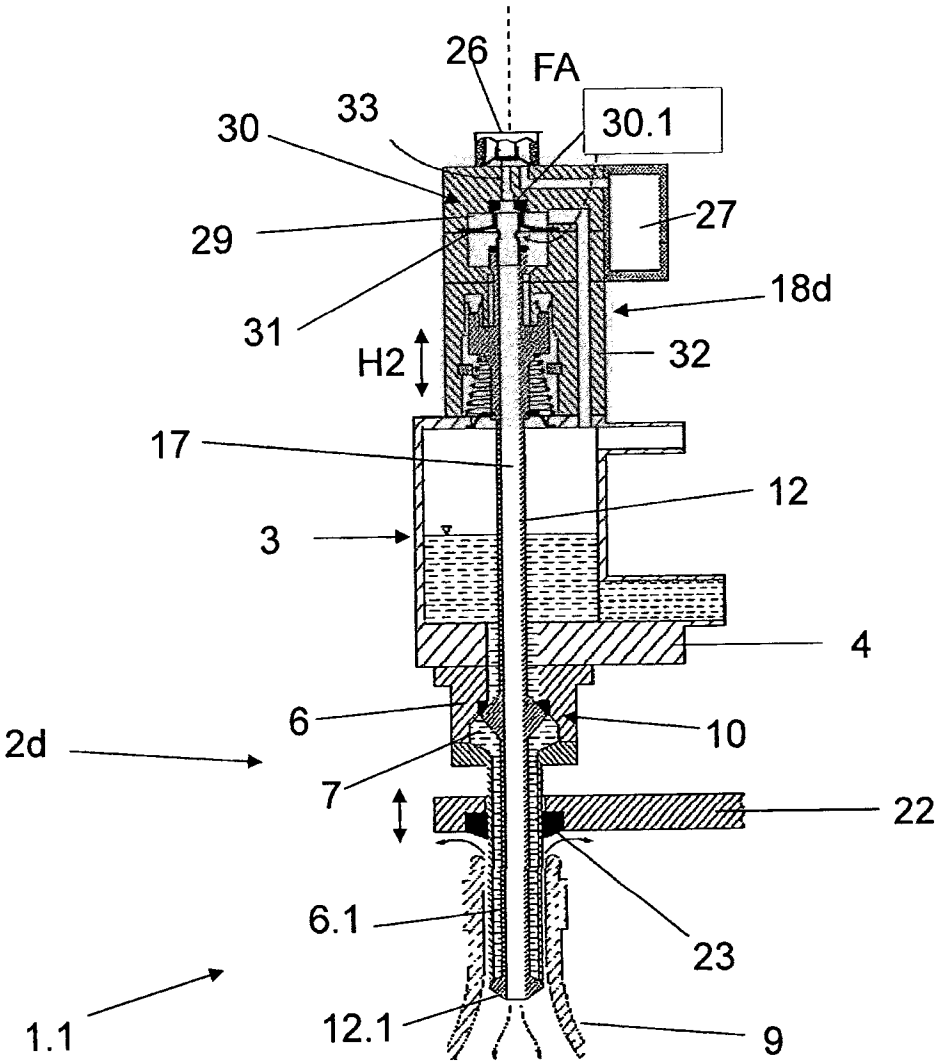

FIG. 6 shows another embodiment in which the ring reservoir 3 comprises only a single chamber. The sole chamber is partially filled with liquid filling-product, and thus corresponds to the lower ring chamber 3.2 in the preceding embodiments.

The filling element 2*d* differs from those described earlier by having an upper open end of the return gas pipe 12 extend into a gas chamber 29, where it interacts with an annular valve seat 30.1 to form a third control-valve 30. A seal 31 seals the passage through which the return-gas tube 12 enters the gas chamber 29. A suitable type of seal 31 is a diaphragm seal 31.

A housing 32 on an upper side of the ring reservoir 3 forms the gas chamber 29 and also houses an actuation device 18*d* for opening and closing the liquid valve 10. The filling system 1.1 further comprises a first ring-duct 27 common to all the filling elements 2*d*, as well as a second control-valve 26, which is a part of the controlled gas path, that opens via a choke 33 in the middle of the annular valve seat 30.1.

With the filling element 2*d*, it is possible to flush the container's interior with flushing gas from the first ring-duct 27 with the liquid valve 10 and the third control-valve 30 closed or with the upper end of the return-gas tube 12 against the annular valve seat 30.1.

The flushing gas flows via the choke 33 into the return-gas duct 17 and down the middle of the container's interior. With the container's mouth unsealed, the return gas forced by the flushing gas out of the container's interior flows into the surrounding environment.

During a flushing procedure, it is possible for some filling product to remain in the return-gas tube 12. When the pressure of flushing gas in the first ring-duct 27 is very high, it is possible for this residual filling material to be blown into a subsequent container during the flushing process. As flushing gas escapes the container, it interacts with droplets of this filling material and splatters filling product on the outside of the container and the surrounding environment. The choke 33 prevents this from happening. However, some embodiments omit the choke 33 and instead maintain a lower flushing pressure in the first ring-duct 27.

The filling phase in this case includes sealing the container 9 against the filling element 2*d* with the second control-valve 26 closed and lowering the return-gas tube 12 to open the liquid valve 10. Filling product then flows into the container 9, displacing gas as it does so. This return gas flows out via the return-gas tube 12, through the opened third control-valve 30, into the gas chamber 29, and eventually into that portion of the ring reservoir 3 that is not occupied by filling product.

Figure 7:
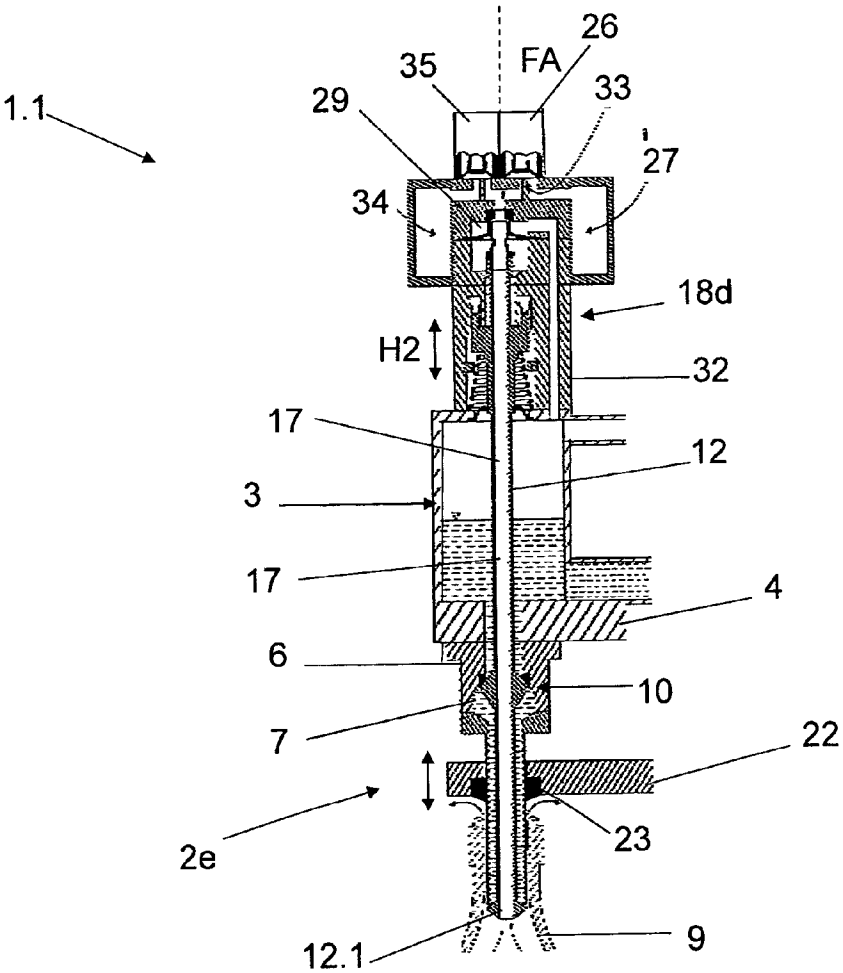

An alternative filling element 2*e*, shown in FIG. 7, includes a first ring-duct 27 and a second ring-duct 34. During the filling phase, the second ring-duct 34 is maintained at an under-pressure or vacuum.

The filling element 2*e* permits both open flushing and closed flushing. In either case, with the liquid valve 10 closed, both the first and second ring-ducts 27, 34 can be connected in a controlled manner with the return-gas tube 12.

The flushing phase includes sealing the container 9 at the filling element 2*e* and evacuating its interior through the return-gas tube 12 and an opened third control-valve 35. This is carried out at a pressure of, for example, 100 mbar above ambient pressure.

The procedure continues with closing the third control-valve 35 and opening the second control-valve 26 to fill the container's interior with flushing gas until atmospheric pressure. Carrying out this flushing phase once fills the container's interior with 95% inert gas. Repeating this procedure can raise the inert gas concentration in the container 9 up to 99%, and can do so with minimal consumption of flushing gas, for example on the order of 150 grams of inert gas/HI.

Figure 8:
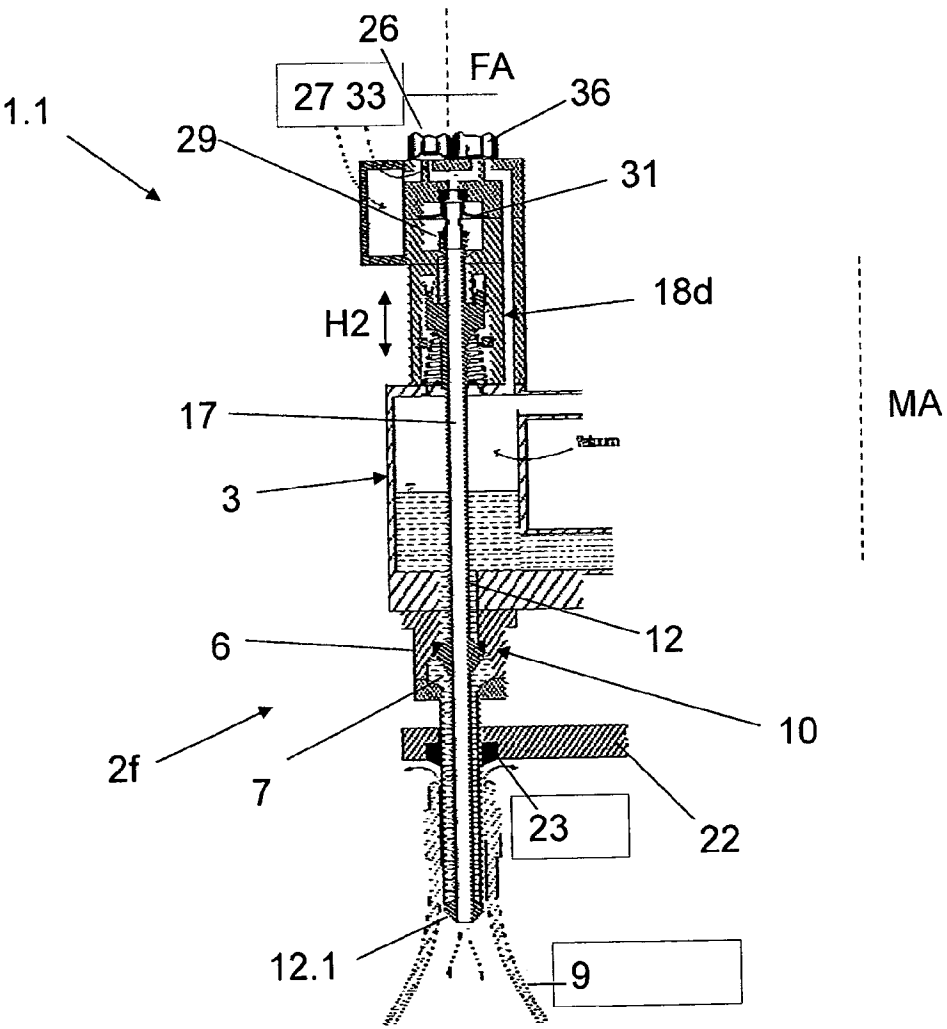

FIG. 8 shows a filling element 2*f* having a fourth control-valve 36 that controls a connection between that part of the ring reservoir 3 that is not occupied by filling product and the opening of the annular valve seat 30.1. A filling system 1.1 comprising such filling elements 2*f* can operate as an under-pressure filling system and carry out open flushing of containers 9 with inert gas.

Figure 9:
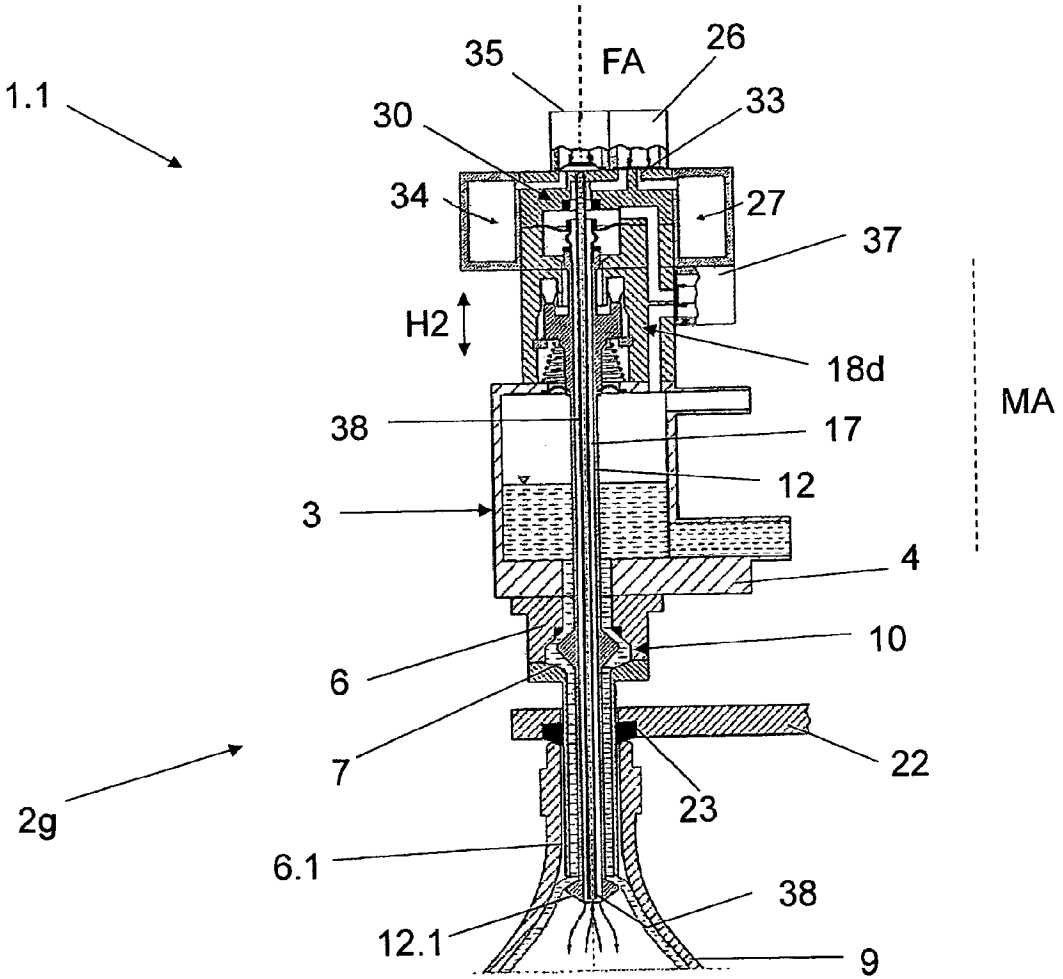

FIG. 9 shows a filling element 2*g* that differs from the filling element 2*e* by having a fifth control-valve 37 disposed to control a connection between the gas chamber 29 and that part of the ring reservoir 3 that is not occupied by any filling product. In addition, the return-gas tube 12 surrounds a gas tube 38 leaving an annular gap that forms the return-gas duct 17. At its open upper-end, the gas tube 38 connects to the second ring-duct 34. The third control-valve 35 controls the connection between the gas tube 38 and the second ring-duct 34. The second control-valve 26 connects only the first-ring duct 27 to the opening that is surrounded by the annular valve seat 30.1.

The filling element 2*g* permits filling containers 9 at differential pressure. This is particularly useful for reducing the time required to fill with highly viscous products such as liquors and syrups. Such filling usually includes causing product remaining after the ending of filling in the return gas pipe 12 and in the gas tube 38 to be emptied into the next container to be filled.

The filling element 2*g* also enables single or multiple flushing of an evacuated container 9 sealed against it.

Evacuation takes place by opening the third control-valve 35. This places the under-pressure in the second ring-duct 34 in communication with the container's interior via the gas tube 38. As a result, any gas in the container 9 tends to be sucked out through the gas tube 38 and into the second ring-duct 34.

Flushing takes place by opening the second control-valve 26. This places the flushing gas in the first ring-duct 27 in communication with the container's interior through the return-gas tube 12.

During the filling phase, the third control-valve 35 opens, thereby exposing the container's interior to the vacuum of the second ring-duct 34. This tends to suck the product into the container 9. Before reaching the intended filling height, the third control-valve 35 closes. Return gas forced out of the container 9 by the filling product then escapes only via the return-gas duct 17 and the opened fifth control-valve 37. This results in a reduced filling speed toward the end of the filling phase.

In an alternative embodiment, the filling element 2*g* is used in a differential pressure procedure. In this procedure, the ring reservoir 3 is also subjected to vacuum. In one embodiment, the vacuum in the second ring-duct 34 is greater than the vacuum in the ring reservoir 3. In another embodiment, the vacuum in the vacuum duct 34 is 600 mbar below atmospheric pressure and the vacuum in the ring reservoir 3 is 400 mbar below atmospheric pressure.

In other embodiments, the upper ring-chamber 3.1 has a cross-section that is lower than that of the ring chamber 3.2, and therefore has reduced volume. This is advantageous for flushing when conducting the return gas displaced by the flushing gas into the upper ring-chamber 3.1.

Having described the invention, and a preferred embodiment thereof, what is new and secured by Letters Patent is:

1. An apparatus comprising a filling system for filling containers with liquid filling-product, said filling system comprising a filling-product reservoir and a filling element arranged below said filling-product reservoir, wherein said filling element comprises a filling-element housing, a liquid-carrying duct, a filling-product discharge-opening, a liquid valve, a valve tappet, a return-gas tube, a first gas-duct, an actuator, a first gas-chamber, and a first control-valve, wherein said filling-element housing is disposed below said filling-product reservoir, wherein said filling-element housing extends along a vertical filling axis, wherein said liquid-carrying duct is formed in said filling-element housing, wherein said liquid-carrying duct communicates with said filling-product reservoir, wherein said liquid-carrying duct forms said filling-product discharge opening, wherein said liquid product discharge-opening is formed on an underside of said filling-element housing, wherein said liquid valve is arranged in said liquid-carrying duct, wherein said return-gas tube forms said first gas-duct, wherein, during filling, said return-gas tube extends into a container interior of a container that is to be filled with said filling product, wherein said actuator causes axial motion along said filling element axis for opening and closing said liquid valve, wherein said first gas-chamber is configured for at least one of conducting away return gas forced out of said interior of said container by said filling product during filling thereof, for imposing a filling pressure in said interior of said container, for flushing said interior of said container with a flushing gas, and for evacuating said interior of said container, wherein said valve tappet serves as a tappet for said liquid valve, wherein said return-gas tube forms said valve tappet, wherein said actuator moves said valve tappet axially for opening and closing of said liquid valve, wherein said actuator, by controlling said axial motion, simultaneously controls said first control-valve, and wherein said first control-valve is arranged in a connection between said first gas-duct and said first gas-chamber, and wherein said actuation device is configured to produce a first axial-lift and a second axial lift, wherein said first axial-lift causes said first control-valve to transition between an open state and a closed state, wherein said second axial-lift causes said liquid valve to transition between a closed state and an open state, wherein said second lift and said first lift add together to cause said first control-valve and said liquid valve to concurrently transition between open and closed states thereof.

2. The apparatus of claim 1, wherein said actuation device comprises a first pneumatic-cylinder and a second pneumatic-cylinder, wherein said second pneumatic-cylinder is in series with said first pneumatic-cylinder, wherein said first pneumatic-cylinder causes said first axial-lift, and wherein said second pneumatic-cylinder causes said second axial-lift.

3. The apparatus of claim 2, further comprising a valve tappet that moves along said filling-element axis in response to movement of one of said first and second pneumatic-cylinders, wherein said valve tappet is configured such that movement thereof causes a change in state of said first control-valve.

4. The apparatus of claim 1, further comprising a valve seat, wherein said valve seat is formed on an end of said return-gas tube, and wherein said first control-valve interacts with said valve seat.

5. An apparatus comprising a filling system for filling containers with liquid filling-product, said filling system comprising a filling-product reservoir and a filling element arranged below said filling-product reservoir, wherein said filling element comprises a filling-element housing, a liquid-carrying duct, a filling-product discharge-opening, a liquid valve, a valve tappet, a return-gas tube, a first gas-duct, an actuator, a first gas-chamber, and a first control-valve, wherein said filling-element housing is disposed below said filling-product reservoir, wherein said filling-element housing extends along a vertical filling axis, wherein said liquid-carrying duct is formed in said filling-element housing, wherein said liquid-carrying duct communicates with said filling-product reservoir, wherein said liquid-carrying duct forms said filling-product discharge opening, wherein said liquid-product discharge-opening is formed on an underside of said filling-element housing, wherein said liquid valve is arranged in said liquid-carrying duct, wherein said return-gas tube forms said first gas-duct, wherein, during filling, said return-gas tube extends into a container interior of a container that is to be filled with said filling product, wherein said actuator causes axial motion along said filling element axis for opening and closing said liquid valve, wherein said first gas-chamber is configured for at least one of conducting away return gas forced out of said interior of said container by said filling product during filling thereof, for imposing a filling pressure in said interior of said container, for flushing said interior of said container with a flushing gas, and for evacuating said interior of said container, wherein said valve tappet serves as a tappet for said liquid valve, wherein said return-gas tube forms said valve tappet, wherein said actuator moves said valve tappet axially for opening and closing of said liquid valve, wherein said actuator, by controlling said axial motion, simultaneously controls said first control-valve, and wherein said first control-valve is arranged in a connection between said first gas-duct and said first gas-chamber, said apparatus further comprising a spring, wherein said spring is disposed to pre-tension said return-gas tube, wherein said spring is configured to bias said liquid valve into a closed position, wherein said actuation device is configured to produce a first axial-lift and a second axial-lift, wherein, upon occurrence of said first axial-lift, said first control-valve opens, and wherein, upon occurrence of said second axial-lift, said liquid valve also opens.

6. The apparatus of claim 1, wherein said filling-product reservoir comprises a first portion and a second portion, wherein said first portion of said filling-product reservoir is unoccupied by said filling product, wherein said first portion said filling-product reservoir forms said first gas-chamber, wherein said return-gas tube comprises an upper end, and wherein said upper end extends into said first portion of said filling-product reservoir.

7. The apparatus of claim 1, wherein said filling-product reservoir comprises a first portion and a second portion, wherein said first portion of said filling-product reservoir is unoccupied by said filling product, and wherein said first gas-chamber connects to said first portion of said filling-product reservoir.

8. The apparatus of claim 7, further comprising a second control-valve, wherein said second control-valve provides a connection between said first gas-chamber and said first portion of said filling-product reservoir.

9. The apparatus of claim 1, wherein said first control-valve comprises a ring-shaped valve seat and an edge, wherein said ring-shaped valve seat surrounds said filling element axis, wherein said edge is an edge at an upper end of said return-gas tube, and wherein said ring-shaped valve seat interacts with said edge to close said first control-valve.

10. The apparatus of claim 9, further comprising a second control-valve and a second gas-chamber, wherein said second control-valve connects to said second gas-chamber, wherein, in a region surrounded by said ring-shaped valve seat, a flow path opens, wherein said second control-valve controls flow through said flow path.

11. The apparatus of claim 10, further comprising a choke, wherein said choke is disposed in said flow path, wherein said choke is configured to restrict gas flow.

12. The apparatus of claim 10, further comprising a vacuum source connected to said second gas-chamber, whereby said second gas-chamber is maintained at an under-pressure.

13. An apparatus comprising a filling system for filling containers with liquid filling-product, said filling system comprising a filling-product reservoir and a filling element arranged below said filling-product reservoir, wherein said filling element comprises a filling-element housing, a liquid-carrying duct, a filling-product discharge-opening, a liquid valve, a valve tappet, a return-gas tube, a first gas-duct, an actuator, a first gas-chamber, and a first control-valve, wherein said filling-element housing is disposed below said filling-product reservoir, wherein said filling-element housing extends along a vertical filling axis, wherein said liquid-carrying duct is formed in said filling-element housing, wherein said liquid-carrying duct communicates with said filling-product reservoir, wherein said liquid-carrying duct forms said filling-product discharge opening, wherein said liquid-product discharge-opening is formed on an underside of said filling-element housing, wherein said liquid valve is arranged in said liquid-carrying duct, wherein said return-gas tube forms said first gas-duct, wherein, during filling, said return-gas tube extends into a container interior of a container that is to be filled with said filling product, wherein said actuator causes axial motion along said filling element axis for opening and closing said liquid valve, wherein said first gas-chamber is configured for at least one of conducting away return gas forced out of said interior of said container by said filling product during filling thereof, for imposing a filling pressure in said interior of said container, for flushing said interior of said container with a flushing gas, and for evacuating said interior of said container, wherein said valve tappet serves as a tappet for said liquid valve, wherein said return-gas tube forms said valve tappet, wherein said actuator moves said valve tappet axially for opening and closing of said liquid valve, wherein said actuator, by controlling said axial motion, simultaneously controls said first control-valve, and wherein said first control-valve is arranged in a connection between said first gas-duct and said first gas-chamber, wherein said filling-product reservoir comprises a first portion and a second portion, wherein said first portion of said filling-product reservoir is unoccupied by said filling product, wherein said first portion of said filling-product reservoir forms said first gas-chamber, wherein said second portion of said filling-product reservoir holds said filling product, and wherein said first gas-chamber is sealed from said second portion of said filling-product reservoir.

14. The apparatus of claim 10, wherein said filling element is one of a plurality of identical filling elements in said filling system, wherein said filling-product reservoir comprises a ring reservoir, wherein said ring reservoir is connected to all of said filling elements, wherein said apparatus further comprises a ring duct that is common to all of said filling elements, and wherein said ring duct forms said second gas-chamber.

15. The apparatus of claim 1, wherein said filling-element housing comprises a tubular housing section that, in operation, extends into said container, and wherein said filling-product discharge opening is provided at said tubular housing section.

16. The apparatus of claim 10, further comprising a further gas tube, wherein said further gas tube is surrounded by said return-gas tube, wherein said further gas tube forms a further gas-duct that opens at a lower end of said gas tube in a region of said filling-product discharge opening, wherein said further gas tube is selectively connected by way of said second control-valve with said second gas-chamber.

17. The apparatus of claim 1, further comprising a rotor that is driven to rotate about a vertical machine axis, wherein said filling element is one of a plurality of identical filling elements on said rotor.

18. The apparatus of claim 10, further comprising a gas source connected to said second gas-chamber, whereby said second gas-chamber, wherein said gas source supplies, to said second gas-chamber, a gas selected from the group consisting of a flushing gas and a pre-tension gas.

19. The apparatus of claim 5, further comprising a rotor that is driven to rotate about a vertical machine axis, wherein said filling element is one of a plurality of identical filling elements on said rotor.

20. The apparatus of claim 13, further comprising a rotor that is driven to rotate about a vertical machine axis, wherein said filling element is one of a plurality of identical filling elements on said rotor.

* * * * *